US006341912B1

(12) United States Patent
Gueret

(10) Patent No.: US 6,341,912 B1
(45) Date of Patent: Jan. 29, 2002

(54) APPLICATOR FOR APPLYING A LIQUID PRODUCT AND MAKE-UP ASSEMBLY PROVIDED WITH SUCH AN APPLICATOR

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/484,033

(22) Filed: Jan. 18, 2000

Related U.S. Application Data

(63) Continuation of application No. 08/500,782, filed on Jul. 11, 1995, now Pat. No. 6,033,143.

(30) Foreign Application Priority Data

Jul. 12, 1994 (FR) ..... 94-08656

(51) Int. Cl.[7] ..... A46B 11/00
(52) U.S. Cl. ..... 401/129; 401/126; 401/118
(58) Field of Search ..... 401/126, 129, 401/130, 128, 118, 127; 15/143.1, 201

(56) References Cited

U.S. PATENT DOCUMENTS

| | | | | |
|---|---|---|---|---|
| 571,367 A | | 11/1896 | Higgins | |
| 643,803 A | | 2/1900 | Schott | |
| 1,389,071 A | | 8/1921 | Pessels | |
| 1,478,388 A | | 12/1923 | Gray | |
| 1,602,551 A | | 10/1926 | Ramsey | |
| 1,795,651 A | | 3/1931 | Hunter | |
| 1,999,642 A | | 4/1935 | Shepherd | |
| 2,291,676 A | * | 8/1942 | Baker | 401/130 |
| 2,296,139 A | | 9/1942 | Blair | |
| 2,348,515 A | | 5/1944 | Baumgartner | |
| 2,664,582 A | | 1/1954 | Kammann | |
| 3,008,169 A | | 11/1961 | Dearing | |
| 3,087,191 A | | 4/1963 | Plunkett | |
| 3,195,544 A | * | 7/1965 | Politzer | 401/130 |
| 3,271,807 A | * | 9/1966 | Cabot | 401/130 |
| 3,601,838 A | | 8/1971 | Marx | |
| D270,669 S | * | 9/1983 | Cassai et al. | D28/3 |
| 4,509,540 A | | 4/1985 | Inagaki | |
| 4,520,526 A | * | 6/1985 | Peters | 15/201 |
| 4,927,281 A | | 5/1990 | Gueret | |
| 4,972,858 A | | 11/1990 | Beck et al. | |
| 5,020,551 A | | 6/1991 | Gueret | |
| 5,357,647 A | | 10/1994 | Gueret | |
| 5,491,865 A | | 2/1996 | Gueret | |
| 5,888,005 A | | 3/1999 | Gueret | |

FOREIGN PATENT DOCUMENTS

| | | | | |
|---|---|---|---|---|
| CH | 155730 | | 7/1932 | |
| DE | 425254 | | 11/1924 | |
| EP | 0 509 852 | | 10/1992 | |
| FR | 1052211 | | 1/1954 | |
| FR | 85853 | | 9/1965 | |
| FR | 2564712 | | 11/1985 | |
| FR | 2603780 | | 3/1988 | |
| GB | 2 082 553 | | 3/1982 | |
| JP | 57017610 A | | 1/1982 | |
| JP | 6-13714 | | 2/1994 | |
| JP | 8-38247 | * | 8/1996 | 401/126 |

OTHER PUBLICATIONS

English translation of French Patent No. 1,174, 544, published Mar. 1959.

English translation of Japanese Utility Model Application No. 6–52712, published Jul. 1994.

English translation of Japanese Utility Model Application No. 58–54210, published Apr. 1983.

* cited by examiner

*Primary Examiner*—David J. Walczak
(74) *Attorney, Agent, or Firm*—Finnegan, Henderson, Farabow, Garrett & Dunner, LLP

(57) ABSTRACT

An applicator for applying a product includes a flexible stem having a first end and a second end, a flexible application member on the first end of the stem, and a handling member on the second end of the stem. The application member and the stem are both configured to flex upon application of the product to a surface. The product may include a cosmetic product and the surface may be on a fingernail.

154 Claims, 5 Drawing Sheets

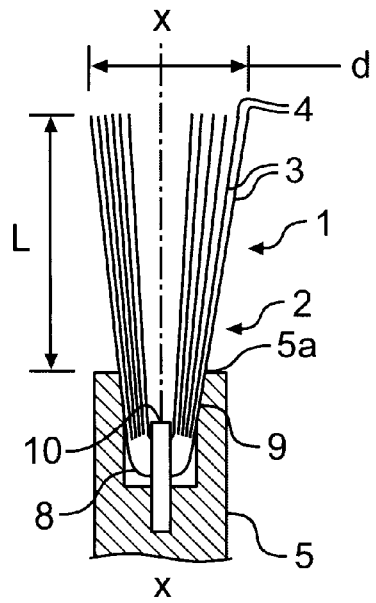
FIG. 2
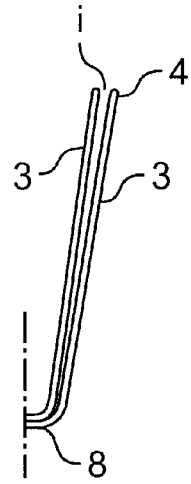
FIG. 3
FIG. 4
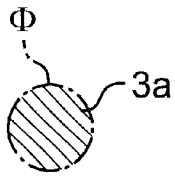
FIG. 5
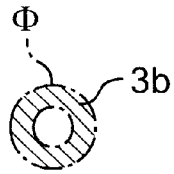
FIG. 6
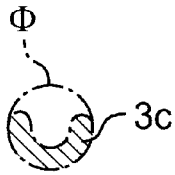
FIG. 7
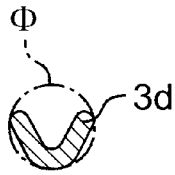
FIG. 8
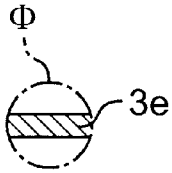
FIG. 9
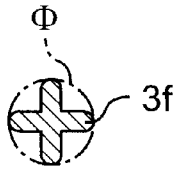

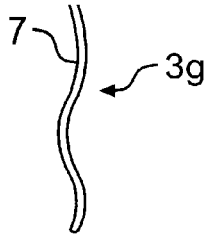
FIG. 10
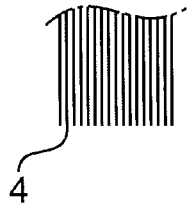
FIG. 11
FIG. 12
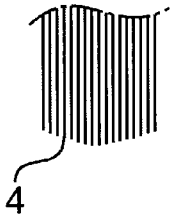
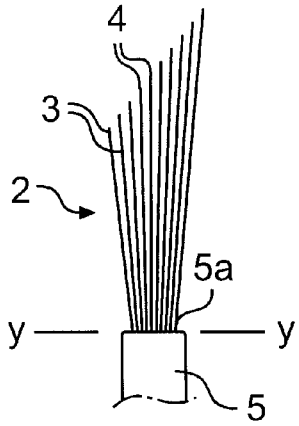
FIG. 13
FIG. 14
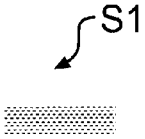
FIG. 15
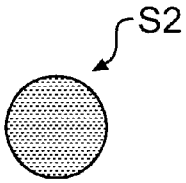
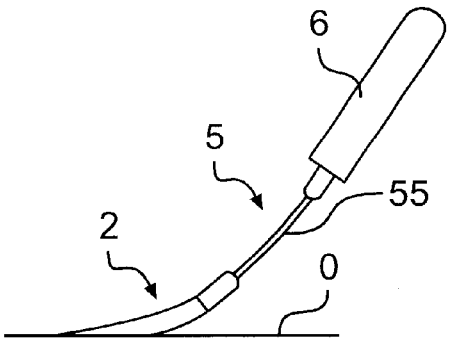
FIG. 17
FIG. 16
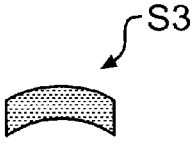

APPLICATOR FOR APPLYING A LIQUID PRODUCT AND MAKE-UP ASSEMBLY PROVIDED WITH SUCH AN APPLICATOR

This is a continuation of application Ser. No. 08/500,782, filed Jul. 11, 1995, now U.S. Pat. No. 6,033,143, which is incorporated herein by reference.

The present invention relates to an applicator for applying a liquid product, such as a nail varnish, a liquid lip color, a liquid foundation or a hair dye, as well as to a make-up assembly provided with such an applicator.

Generally a make-up assembly comprises a reservoir for the product to be applied and a member for applying the said product, including an application member consisting of bristles which are arranged substantially parallel to each other in the form of a tuft and are fixed to a support called applicator stem. This applicator is, in principle, a brush. This assembly furthermore comprises a sleeve intended to close the reservoir, the stem of the applicator in this sleeve being fixed so that the tuft is immersed in this product.

Brushes provided up to now for applying a layer of varnish to nails leave something to be desired as regards the uniformity and gentleness of application, and the speed of making-up, especially the uniformity and speed of applying a varnish to nails, this being unsatisfactory from an aesthetic standpoint. Thus, with a conventional nail-varnish brush, a layer of varnish is quite often deposited which is not uniform, but marked by streaks coming from the bristles of the brush. This effect is all the more pronounced when a second layer of varnish is deposited on the nails when the first has not completely dried.

Furthermore, with a conventional make-up brush, it is usually necessary to dip the brush several times into the container holding the product in order to paint one nail after the other, since the charge of product taken up by the brush is relatively small. Various solutions have already been proposed in order to remedy this drawback, for example the incorporation of a kind of reservoir in the stem of the brush, as described in document FR-A-2,585,934, but this solution complicates the manufacture and the use of the brush, and is relatively expensive.

In order to remedy these drawbacks, it would be conceivable to lengthen the bristles, but in this case the bristles move too far apart, which does not allow accurate application of the make-up.

The object of the present invention is, especially, to provide a make-up applicator which allows make-up to be applied rapidly, while at the same time conveying much more product than a conventional brush. Thus, this applicator has greater autonomy and makes it possible to deposit a layer thickness greater than with a conventional brush, hence resulting in greater ease of application for the user.

After many experiments, the Applicant has observed that, by varying the flexibility of the stem of such an applicator, it was possible, surprisingly, to apply a more uniform layer of make-up product, especially when it is an applicator intended for applying nail varnish. In addition, for the deposition of a second layer of varnish, it is not necessary to wait for complete drying of the first.

The Applicant has observed that, by varying the flexibility of the stem of an applicator, it was possible to obtain a much more uniform layer of varnish on the nail than with an applicator having a rigid stem, without forming streaks in the layer of varnish deposited on the nail. In this case, it was observed that the applicator draws the product over the surface of the nail by capillary effect. Consequently, the application member "floats" over the layer of varnish deposited, without scratching and without forming streaks. Furthermore, it even removes all types of streaks, and a second layer may be applied right after the first layer has been spread, without waiting for it to dry, which shortens the overall application time. Likewise, the Applicant has observed that it was possible to use a stiffer application member than the one used conventionally, which allows the use of varnishes having a viscosity outside the range normally used.

Surprisingly, it has been observed that the appearance of the make-up thus obtained was more shiny, that the mechanical strength of the layer applied, after drying, was increased and that the bondability of the varnish to the nail was increased.

Thus, the invention relates to an applicator for applying a make-up product, including an application member having a defined flexibility, this member being fixed to one end of a stem, characterized in that the stem has a flexibility similar to that of the application member.

By the phrase "flexibility similar to the application member" is meant a flexibility such that, when applying the product to a surface, for example a varnish to a nail, the application member and the flexible part of the stem form a curve with a virtually constant curvature, especially in the form of an arc of a circle. This flexibility of the stem is chosen, especially, so that the force F to be applied in order to bend the stem lies within the range: $0.3\ f \leqq 5\ F \leqq 3\ f$, f being the force necessary to bend the application member. Preferably, the flexibility of the stem is chosen to be at most equal to that of the application member.

According to the invention, the stem has a length advantageously chosen from the range going from 2 to 20 cm, preferably from 2 to 4 cm, and it has a diameter lying within the range from 2.5 to 5.0 mm, preferably from 2.5 to 3.5 mm.

According to a first embodiment, the flexible stem is made of an elastomeric material. Advantageously, this material is chosen from the group elastomers of polyethylene, of polyurethane, of polyester; polyether-block-amides; polyvinyls; terpolymers of ethylene, propylene and a diene (EPDM); styrene-butadiene block copolymers (SEBS-SIS). In particular, the elastomeric material has a hardness lying within the range of from 35 to 90 Shore A, preferably from 50 to 70 Shore A. The stem may include at least one region of smaller cross-section; this small cross-section lies, for example, within the range of from 0.2 to 1.8 $mm^2$, preferably from 0.4 to 1.2 $mm^2$, over a length ranging from 2 to 20 mm, for a maximum cross-section ranging from 4 to 20 $mm^2$, and preferably from 6 to 12 $mm^2$. In other words, the small cross-section is a cross-section chosen so that the ratio S/s lies between 2 and 100, s being the smallest cross-section and S the largest cross-section.

According to a second embodiment, the flexible stem is produced, at least in part, from a wire, for example a steel piano wire whose diameter is chosen, for example, from the range going from 0.15 to 1.0 mm, preferably from 0.15 to 0.3 mm, and whose length lies advantageously within the range from 0.5 to 8 cm, preferably from 1 to 4 cm.

As a variant of this second embodiment, at least one region of the stem consists of a helical spring formed by touching or non-touching turns.

According to a third embodiment, the stem may be made of a relatively hard material, such as high-density polyethylene or low-density polyethylene (HDPE or LDPE), the hardness of which is chosen from the range from 90 Shore A to 40 Shore D, and preferably from 90 to 95 Shore A. Under these conditions, the stem, when it is cylindrical, is provided in particular with at least one region of smaller cross-section— this small cross-section has, for example, the dimensions given hereinabove.

In particular, the stem may include, in the region of smaller cross-section, a flattened, hollowed out, spiral-shaped or concertina-shaped part, in order to make it flexible.

In accordance with the invention, the application member may be fixed directly to the end of the stem.

According to the invention, the application member may be a loop, a bundle of fibers or a spatula.

Advantageously, according to a first embodiment variant of the invention, the application member consists, conventionally, of a tuft of substantially parallel bristles. The tuft of bristles has, especially, a length (L) ranging from 8 to 40 mm, and preferably from 11 to 20 mm. In this case, the applicator constitutes a brush.

According to this variant, the nail-varnish applicator preferably includes a tuft of approximately 100 to 1200, and preferably from 120 to 500 bristles of a diameter ranging, for example, from 4/100th to 25/100th of a mm and preferably from 6/100th to 17/100th of a mm, these bristles generally being made of a polyamide, for example nylon-6, nylon-6,6, nylon-6,10, nylon-6,12 or nylon-11, polyester, polymethacrylate, polyacetal or cellulose acetate. The bristles may, if required, be of natural origin.

According to a second variant of the invention, the application member may consist of an elongate loop, a tuft of fibers or large bristles, or an application spatula which is flattened or in the form of a cellular foam with open cells. This application member may be provided, on its surface, with a flock coating. Advantageously, this member is fixed to the end of the stem by adhesive bonding, for example, but fixing may be achieved by any other known means.

It is also possible to equip the applicator, in accordance with the invention, with bristles made of thermoplastic elastomer chosen from the group of elastomers of polyethylene, of polyurethane, of polyester; of polyether-block-amides; polyvinyls; terpolymers of ethylene, propylene and a diene (EPDM); styrene-butadiene block copolymers (SEBS-SIS); silicone elastomers or nitrile elastomers. Advantageously, the thermoplastic elastomer has a Shore A hardness lying within the range from 15 to 90 and preferably from 30 to 60 Shore A. Under these conditions, their diameter is advantageously chosen from the range going from 4/100th to 35/100th of a mm, preferably from 10/100th to 20/100th of a mm.

The material making up the bristles may contain an agent modifying their surface finish and/or their slip characteristics and/or reducing their wettability to water and/or to solvent, or else an antistatic agent.

Advantageously, the agent improving the slip characteristic of the bristle and reducing its wettability to water and solvent is incorporated into the material of the bristles at an amount lying between 0.2% and 15% by weight, and preferably between 0.3 and 5% by weight.

This slip agent is preferably chosen from the group formed by polytetrafluoroethylene, boron nitride, molybdenum disulphide, graphite, silicones, fullerene, talc.

According to another advantageous aspect of the invention, the bristles have a first end obtained by bending a fibre into a U, the base of the U being held by a staple pressed right into a housing made in the free end of the stem of the applicator. Advantageously, this housing has the shape of a cylinder of revolution. It may also be envisaged to shape it into an elongate oval or cruciform shape or into the form of a half-round tile. This housing may be flared towards the free end of the stem the tuft of bristles may also be fixed into the housing of the stem of the applicator by adhesive bonding or by any other means normally used for manufacturing brushes, for example by a ferrule.

At least part of the bristles may have slight corrugations over their length. The bristles may have cross-sections whose shape is chosen from the group of circular, annular, polygonal, cruciform, rectangular or multilobed shapes, or shapes in the form of a U, in the form of a C or in the form of a V, or shapes including at least one capillary groove. The free end of the bristles may be made in the form of a pin head, especially obtained by heat treatment, for example by flame brushing. The free end of the bristles may also be made with a tapered shape, obtained, for example, by grinding or by carding.

The cross-section of the applicator may have various shapes, it being possible for the tuft to have, especially, a circular cross-section, a cross-section in the form of a half-round tile, an oval cross-section or a cruciform cross-section. The free end of the applicator may be flat or rounded.

The applicator having the characteristics which have just been described is particularly suitable for applying a nail varnish, a liquid make-up or a hair dye, especially a product having a high viscosity. In the case of a varnish, this may be a composition which may or may not include toluene or formol; it may also include a solvent system comprising water and/or alcohols.

The present invention also relates to a nail-varnish application assembly consisting of a reservoir, generally made of glass, equipped with a neck and with a sleeve integral with an application member immersed, in the storage position, in a nail varnish contained in this reservoir, which assembly is characterized in that the application member is an applicator, as defined previously.

The invention consists, apart from the arrangements expounded hereinabove, of a certain number of other arrangements which will be explained in more detail hereinbelow, with regard to embodiment examples which are described with reference to the appended drawings but which are in no way limiting.

FIG. 1 is a simplified elevation view of a nail-varnish assembly in accordance with the invention.

FIGS. 1*a* to 1*k* represent various embodiments of an applicator with a flexible stem in accordance with the invention, FIGS. 1*a* to 1*g* in accordance with a first embodiment variant including a brush, FIG. 1*e* showing, on an enlarged scale, the brush of FIG. 1, FIGS. 1*h* to 1*k* representing applicators with no brush, in accordance with a second embodiment variant.

FIG. 2 is a diagrammatic view on a larger scale, in partial axial section, of the end of the stem of the applicator of FIG. 1, provided with a tuft of bristles.

FIG. 3 is a diagrammatic view on a larger scale of bristles of the applicator of FIG. 2, after they have been embedded in the stem.

FIGS. 4 to 9 are diagrams of various possible cross-sections of the bristles, inscribed in a circle of constant diameter (ø).

FIG. 10 shows a bristle having a slight corrugation.

FIGS. 11 and 12 show, in elevation on a large scale, two possible shapes for the free end of the applicator.

FIG. 13 is a side view of another possible conformation for the free end of the applicator.

FIGS. 14 to 16 illustrate three possible cross-sections for the housing of the end of the stem of the applicator receiving the tuft of bristles.

FIG. 17 shows an applicator with a flexible stem, according to the invention, during application of a varnish.

Figure 1:
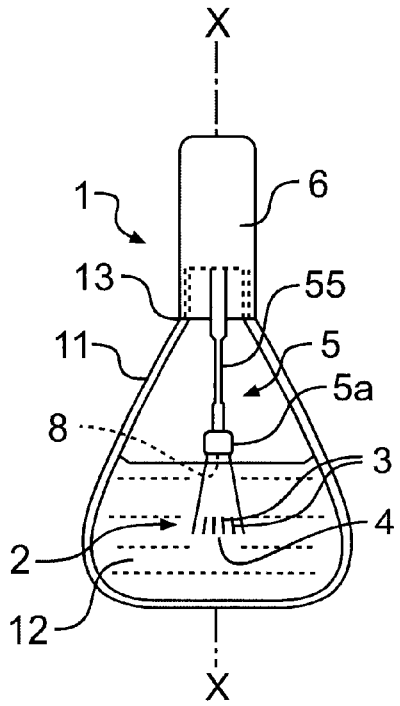

Referring to FIG. 1 of the drawings, a nail-varnish assembly may be seen which comprises an applicator (1) for applying the varnish, according to a first embodiment variant, the applicator (1) being provided with a tuft (2) of bristles (3), for example made of nylon-6,10, which is fixed to a free end (5*a*) of a flexible stem (5) and is oriented substantially along the axial direction of the stem.

The flexible stem is made of a thermoplastic, fox example polyethylene; it is cylindrical and has a diameter of approximately 2.5 to 3.5 mm. Its length is especially 4 cm. A central region (55), of smaller cross-section ranging from 0.2 to 1.8 $mm^2$, is provided on this stem, conferring on it a defined flexibility, similar to that of the tuft (2) of bristles (3). This region (55) may be seen more clearly in FIG. 1*e*. A cylindrical sleeve (6) is integral with the other end (5*b*) of the stem (5) opposite the tuft (2), this end (5*b*) being shaped in the form of a fastening cap forcibly inserted into the sleeve (6). This cylindrical sleeve (6) serves as a member for handling the applicator. It also serves as a stopper intended, especially, to be screwed onto the neck (13) of a bottle (11) of varnish. The varnish bears the reference (12).

FIGS. 1*a* to 1*k* illustrate various embodiment examples of an applicator including a flexible stem.

Figure 1A:
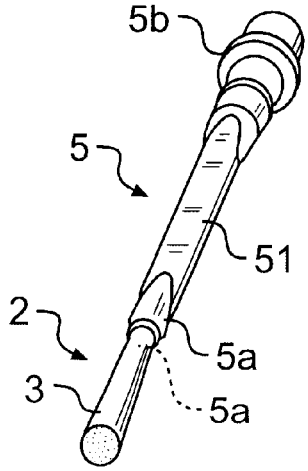

Thus, FIG. 1*a* shows an applicator including a flexible stem (5), a first end (5*a*) of which is fastened to a first end (8) of a tuft (2) of bristles (3). A second end (5*b*) of the stem is shaped in the form of a fastening cap intended to be forcibly inserted into the sleeve (6) in order to fasten it to the flexible stem. The stem is advantageously made of HDPE or LDPE (high-density polyethylene or low-density polyethylene) and includes a region (51) in the form of a flattened tongue, conferring on the stem a defined flexibility and extending virtually over the entire length of the stem.

Figure 1B:
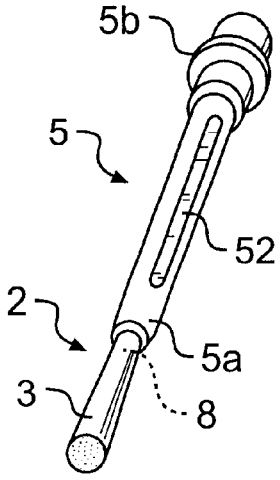

The applicator of FIG. 1*b* has substantially the same shape as that of FIG. 1*a*, with the exception that the stem (5) is cylindrical but includes a longitudinal slot (52) in order to ensure flexibility of the stem.

Figure 1C:
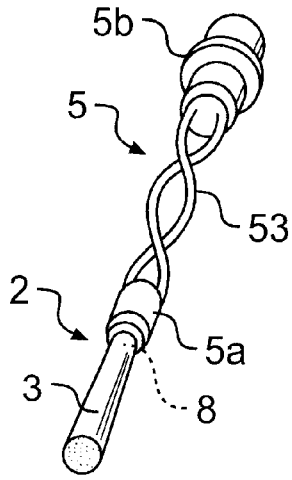

FIG. 1*c* shows an applicator whose stem (5) is formed, in part, by two strips (53) arranged in the form of two entwined helices forming a twin-start spiral.

Figure 1D:
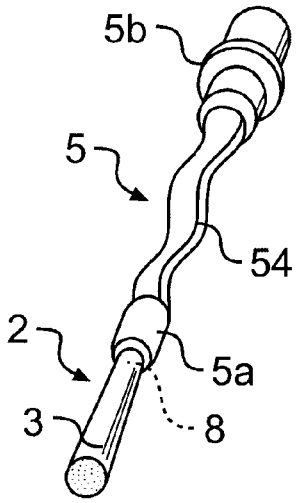

FIG. 1*d* shows an applicator whose stem (5) is formed, over the major part of it, by a flat strip (54) which is shaped in the form of a "concertina" or includes corrugations.

Figure 1E:
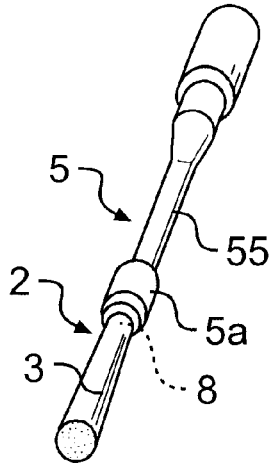

FIG. 1*e* shows, in enlarged view, the applicator represented in FIG. 1, the stem (5) of which is cylindrical and includes a central region (55) of reduced cross-section—the stem has a maximum cross-section of approximately 4 to 20 $mm^2$ and the region (55) has a cross-section of approximately 0.2 to 1.2 $mm^2$. The region (55) may extend over a length lying between 2 and 20 mm. This region, when it is covered with varnish, constitutes a mini-reservoir so that the tuft (2) is fed with a controlled flow of varnish. In addition, in this region, the mini-reservoir of the varnish does not dry as redily as compared to a stem that does not include a reduced cross-section forming a mini-reservoir.

Figure 1F:
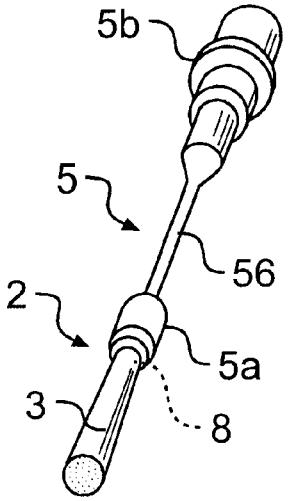

FIG. 1*f* shows an applicator in accordance with a second embodiment, the stem (5) of which includes a region (56) formed, in part, by a steel wire, for example a portion of a piano wire having a diameter of approximately 0.3 mm.

Figure 1G:
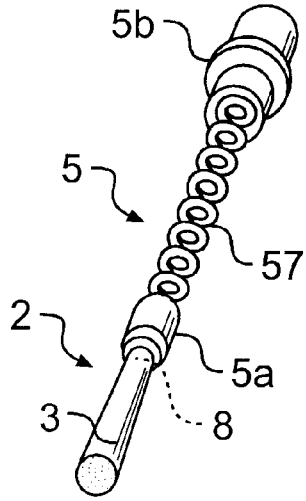

FIG. 1*g* shows an applicator according to a second embodiment, the stem (5) of which includes a region formed by a metal spiral (57) having touching or non-touching turns, such as a helical spring, having a wire diameter of approximately 0.3 mm and a turn diameter of approximately 3 mm.

Figure 1H:
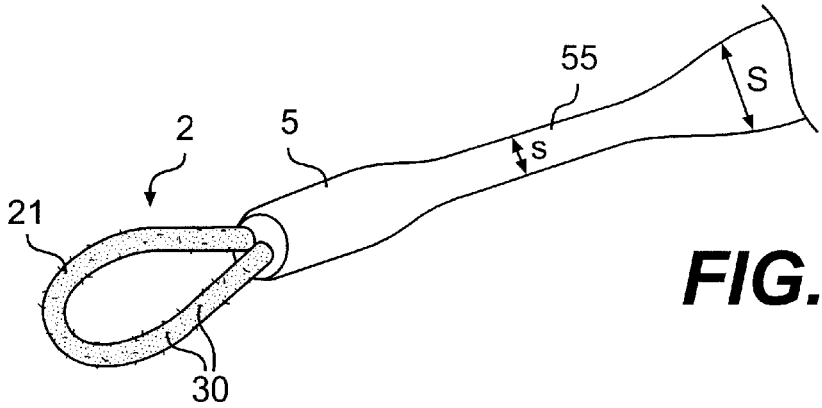

FIG. 1*h* shows, according to another embodiment variant, an applicator whose stem (5) is cylindrical and includes a central region (55) of reduced cross-section—the stem has a normal cross-section of approximately 4.0 to 20 $mm^2$ and the region (55) has a cross-section of approximately 0.2 to 1.8 $mm^2$. The region of smaller cross-section is a cross-section chosen so that the ratio S/s lies between 3 and 100, s being the smallest cross-section and S the largest cross-section.

The application member (2) is a cord (21) in the form of a loop, provided with a flock coating (30). This cord includes, for example, a core made of polyvinyl chloride elastomer, polyurethane elastomer or polyester elastomer, this core having a diameter of 0.1 to 3 mm. The entire surface of the cord is covered with a flock coating (30), of conventional construction, for example made of nylon fibers having a diameter of approximately 2/100th of a mm and a length chosen from the range going from 0.1 to 1.5 mm.

Figure 1I:
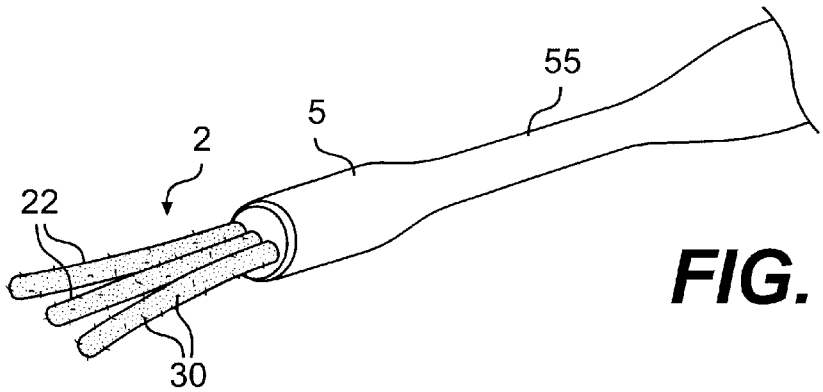

FIG. 1*i* shows, according to another embodiment variant, an applicator whose stem (5) is cylindrical and includes a central region (55) of reduced cross-section, as in FIG. 1*h*. The application member (2) is a bundle of fibers (22) having received a flock coating (30). The fibers are, for example, made of nylon which has a core having a diameter of approximately 4/100th to 60/100th of a mm and include a flock coating of the same type as the one in FIG. 1*h*.

Figure 1J:
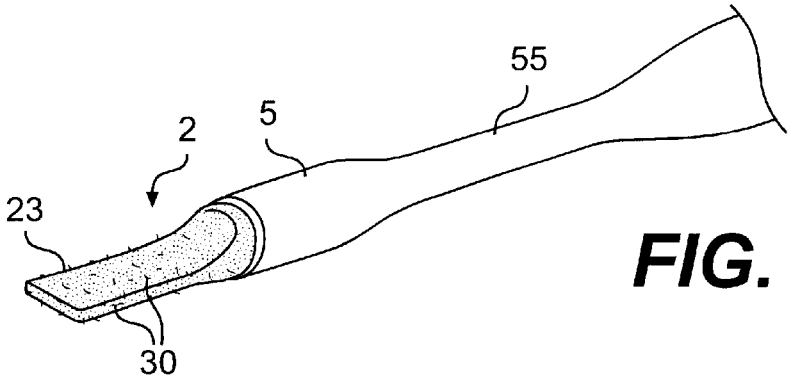

FIG. 1*j* shows, according to another embodiment variant, an applicator substantially similar to that of the preceding figures, with the exception that the application member is a spatula (23) of flattened shape, made of a flexible or semi-flexible thermoplastic, for example a polyvinyl chloride elastomer or polyurethane elastomer, including a flock coating of the same type as that of the application member represented in FIG. 1*h*.

Figure 1K:
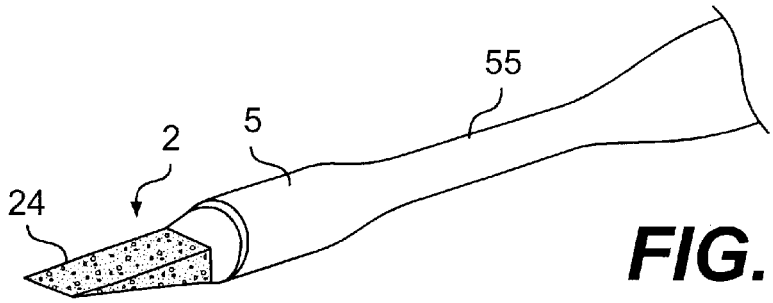

FIG. 1*k* shows, according to another embodiment variant, an applicator substantially similar to that of the preceding figure, with the exception that the application member is a spatula (24) made of foam, for example a polyurethane, polyether or latex foam with open cells.

The application member (2), in accordance with FIGS. 1*h* to 1*k*, is fixed, advantageously by welding or adhesive bonding, to the free end (5*a*) of the stem (5). It may be mounted on the stem represented in FIGS. 1*a* to 1*g*.

The tuft (2) of the applicators in the form of a brush, in accordance with FIGS. 1*a* to 1*g*, according to the first embodiment variant, may be obtained from a bundle of substantially parallel bristles (3) folded in two, approximately at mid-length. The tuft (2) is fixed to the free end (5*a*) of the stem (5) by engaging the folded part (8) of the tuft of bristles, as shown in FIG. 2, tightly in a housing (9) formed by a blind hole opening at the end of the stem (5). Generally, the tuft (2) is produced by placing the middle region of the bundle of bristles over the entrance of the housing (9) of the stem (5). A staple (10) is engaged around the region located substantially halfway along the bundle of bristles and is pressed right into the housing (9), thereby causing the bristles (3) to fold, the bristles bearing against the edge of the housing (9). During this operation, the staple (10) is bent over so as to clamp the bristles and is forcibly engaged into the stem (5).

The staple (10) is advantageously made from a wire bent into a U, the cross-section of which may be circular, rectangular, flat or square. The diameter or the large side of the cross-section of the wire advantageously lies in the range from 0.2 mm to 1.5 mm. The end region of the housing (9), as can be seen in FIG. 2, may be a cylinder of revolution with an end region in the form of a flared truncated cone of revolution, thus favoring the separation of the bristles (3). The tuft (2) of the brush (1), embedded in such a housing, has a shape in the form of a truncated cone with a substantially circular base (see FIG. 15).

The conditions under which the bristles (3) are embedded in the housing (9), as can be seen in FIG. 3, play a decisive role in the creation of interstices (i). In fact, this interstice (i) is a key factor in determining the amount of product taken up and therefore the extent of the autonomy of the brush.

Capillary reserves of the product to be applied are thus created, enabling the charge of product to be varied depending on its viscosity.

As may be seen in FIGS. 4 to 9, the cross-sections of the bristles (3) are inscribed in a circle (ø) of diameter lying between 8/100 and 30/100 of a mm —preferably the cross-section is chosen from the range of from 11/100 to 25/100 of a mm. The cross-sections of the bristles (3) may have variable shapes—they may be solid circular (3*a*) as illustrated in FIG. 4, hollow circular (3*b*) as illustrated in FIG. 5, C-shaped (3*c*) as may be seen in FIG. 6, in the form of an L or a V (3*d*) as may be seen in FIG. 7; they may have a flat shape (3*e*) as may be seen in FIG. 8, or be polygonal, in particular square or cruciform (3*f*), as may be seen in FIG. 9. According to the embodiment of FIG. 10, the bristles (3*g*) may not be straight but have, at least over part of their length, slight corrugations (7).

These bristles, of the same type or of a mixture of various types (see FIGS. 4 to 9) of these bristles, are shaped in the form of a tuft (2). According to FIG. 11, the end of the tuft (2) is flat, of substantially rectilinear shape. According to FIG. 12, the ends (4) of the bristles (3) together have a rounded configuration obtained, for example, by clipping. According to the embodiment in accordance with FIG. 13, the ends (4) of the bristles (3) have been clipped so that they slope.

The brush (1) at its tuft (2) may have various cross-sectional shapes; according to FIG. 14, the cross-section (S1) of the tuft is flat, of substantially rectangular shape. According to FIG. 15, the cross-section (S2) of the tuft is circular. In these cases, the brush may also have a rounded-tile cross-section (S3), as may be seen in FIG. 16, such an applicator matching the shape of the nail better.

FIG. 17 shows an applicator with a flexible stem, according to the invention, during application of a varnish. It may be seen that the tuft (2) of bristles and the flexible part (55) of the stem (5) form a virtually constant curve, substantially an arc of a circle, so that the tuft (2) is in contact with the nail (O) substantially tangentially.

When a cylindrical brush in accordance with the first variant of the present invention is produced, the diameter of the tuft (2) of the bristles (3) generally lies within the range from 0.5 to 6 mm; by virtue of the use of a flexible stem as described previously, an applicator is obtained which, during application, draws the varnish instead of pushing it, as in a conventional applicator.

The applicator having the characteristics which have just been described is particularly well suited for applying a nail varnish, a liquid make-up or a hair dye, especially a varnish with a high viscosity. This varnish may have a composition which may or may not include toluene or formol; this varnish may also include a solvent system comprising water and/or alcohols.

The layer of varnish deposited is very uniform, thick, deposited accurately and has, after drying, improved adhesion properties. The surface has a shiny appearance. The varnish may be deposited in a single go or possibly in two goes, it being possible for the second layer to be deposited on the first, before this has dried. No streaks are formed.

What is claimed is:

1. A cosmetic product application system, comprising:

a flexible stem having a first end and a second end;

a flexible application member on the first end of the stem, the stem being at least as flexible as the application member;

a handling member on the second end of the stem; and a reservoir for containing a cosmetic product and configured to receive the application member, wherein both the application member and the stem are configured to flex upon application of the cosmetic product to a surface.

2. The application system of claim 1, wherein the surface is on a fingernail.

3. An applicator for applying a cosmetic product, comprising:

a flexible stem having a first end and a second end;

a flexible application member on the first end of the stem, the stem being at least as flexible as the application member; and a handling member on the second end of the stem, wherein both the application member and the stem are configured to flex upon application of the cosmetic product to a surface.

4. The applicator of claim 3, wherein the surface is on a fingernail.

5. The applicator of claim 3, wherein at least one region of the stem has a reduced cross-section.

6. The applicator of claim, 3, wherein the stem includes a flattened portion.

7. The applicator of claim 3, wherein at least a portion of the stem is concertina-shaped.

8. The applicator of claim 3, wherein at least a portion of the stem is spiral-shaped.

9. The applicator of claim 3, wherein at least a portion of the stem forms a helix.

10. The applicator of claim 9, wherein turns of the helix are touching.

11. The applicator of claim 9, wherein turns of the helix are non-touching.

12. The applicator of claim 3, wherein the application member includes an elongate loop.

13. The applicator of claim 3, wherein the application member includes a spatula.

14. The applicator of claim 3, wherein the spatula is substantially flat.

15. The applicator of claim 3, wherein the application member includes large finger-like bristles.

16. The applicator of claim 3, wherein surface finish of the application member is modified.

17. The applicator of claim 3, wherein the application member includes an agent that modifies slip characteristic.

18. The application member of claim 17, wherein the agent is chosen from polytetrafluoroethylene, boron nitride, molybdenum disulphide, graphite, silicones, fullerene, and talc.

19. The application member of claim 3, wherein the application member includes an agent that modifies wettability.

20. The application member of claim 19, wherein the water wettability is modified.

21. The application member of claim 19, wherein the solvent wettability is modified.

22. The application member of claim 19, wherein the agent is chosen from polytetrafluoroethylene, boron nitride, molybdenum disulphide, graphite, silicones, fullerene, and talc.

23. The application member of claim 3, wherein the application member includes an anti-static agent.

24. The application member of claim 3, wherein the application member includes a tuft of bristles.

25. The application member of claim 3, wherein the application member is coated with flock coating.

26. The application member of claim 3, wherein at least part of the stem is made of an elastomeric material.

27. The application member of claim 26, wherein the elastomeric material is chosen from elastomers of polyethylene, of polyurethane, of polyester; polyether-block amides; polyvinyls; terpolymers of ethylene, proplylene and a diene; and styrene-butadiene block copolymers.

28. The applicator of claim 26, wherein the elastomeric material has a hardness lying within the range from 35 to 90 Shore A.

29. The applicator of claim 3, wherein the stem has a diameter from 2.5 to 5 mm.

30. The applicator of claim 3, wherein the stem is at least partly made from wire.

31. The applicator of claim 3, wherein the stem has a length from 2 to 20 cm.

32. The applicator of claim 3, wherein the application member has a length from 8 to 40 mm.

33. The applicator of claim 3, wherein the stem includes a first region and a second region, the second region having a cross-section less than that of the first region.

34. The applicator of claim 33, wherein a ratio of the cross-section of the first region to the cross-section of the second region is between 2 and 100.

35. An applicator for applying a cosmetic product, comprising:

a flexible stem having a first end and a second end, at least one region of the stem having a reduced cross-section as compared to the remainder of the stem, wherein the remainder of the stem extends beyond the handling member;

a flexible application member on the first end of the stem; and a handling member on the second end of the stem, wherein both the application member and the stem are configured to flex upon application of the cosmetic product to a surface, and the application member is configured to apply the cosmetic product to the surface by placing at least a portion of the length of the application member in contact with the surface.

36. The applicator of claim 35, wherein a ratio of cross-sectional area of the one region of the stem to a cross-sectional area of the remainder of the stem ranges from 0.01 to 0.5.

37. The applicator of claim 35, wherein the one region of the stem is flattened.

38. The applicator of claim 35, wherein the application member has a length ranging from 8 mm to 40 mm.

39. The applicator of claim 35, wherein the application member includes a tuft of bristles.

40. The applicator of claim 35, wherein the application member includes an elongate loop.

41. The applicator of claim 35, wherein the application member includes a spatula.

42. The applicator of claim 35, wherein the application member includes large finger-like bristles.

43. The applicator of claim 35, wherein the surface is on one of a fingernail and skin.

44. An applicator for applying a cosmetic product, comprising:

a flexible stem having a first end and a second end, at least one region of the stem having a reduced cross-section as compared to the remainder of the stem, wherein the remainder of the stem extends beyond the handling member;

a flexible application member on the first end of the stem, the application member extending substantially parallel to a longitudinal axis of the stem; and a handling member on the second end of the stem, wherein both the application member and the stem are configured to flex upon application of the cosmetic product to a surface.

45. The applicator of claim 44, wherein a ratio of a cross-sectional area of the one region of the stem to a cross-sectional area of the remainder of the stem ranges from 0.01 to 5.

46. The applicator of claim 44, wherein the one region of the stem is flattened.

47. The applicator of claim 44, wherein the application member has a length ranging from 8 mm to 40 mm.

48. The applicator of claim 44, wherein the application member includes a tuft of bristles.

49. The applicator of claim 44, wherein the application member includes an elongate loop.

50. The applicator of claim 44, wherein the application member includes a spatula.

51. The applicator of claim 44, wherein the application member includes large finger-like bristles.

52. The applicator of claim 44, wherein the surface is on one of a fingernail and skin.

53. A cosmetic product application system, comprising:

a flexible stem having a first end and a second end, at least one region of the stem having a reduced cross-section as compared to the remainder of the stem, wherein the remainder of the stem extends beyond the handling member;

a flexible application member on the first end of the stem;

a handling member on the second end of the stem; and a reservoir for containing a cosmetic product, the reservoir being configured to receive the application member, wherein both the application member and the stem are configured to flex upon application of the cosmetic product to a surface.

54. The application system of claim 53, wherein a ratio of a cross-sectional area of the one region of the stem to a cross-sectional area of the remainder of the stem ranges from 0.01 to 0.5.

55. The application system of claim 53, wherein the one region of the stem is flattened.

56. The application system of claim 53, wherein the surface is on one of a fingernail and skin.

57. The application system of claim 53, wherein the reservoir contains a nail varnish.

58. A method of applying make-up to one of skin and fingernails, comprising:

providing an applicator including a flexible stem having a first end and a second end, at least one region of the stem having a reduced cross-section as compared to the remainder of the stem, a flexible application member on the first end of the stem, and a handling member on the second end of the stem, wherein the remainder of the stem extends beyond the handling member;

loading the application member with make-up;

applying the make-up to the one of skin and fingernails by drawing the application member across the one of skin and fingernails; and flexing both the stem and the application member during the applying of the make-up.

59. The method of claim 58, wherein a ratio of a cross-sectional area of the one region of the stem to a cross-sectional area of the remainder of the stem ranges from 0.01 to 0.5.

60. The method of claim 58, wherein the at least one region of the stem is flattened.

61. An applicator for applying a cosmetic product, comprising:

a flexible stem having a first end and a second end;

a flexible application member on the first end of the stem, at least part of the stem being formed of a material differing from a material forming at least part of the application member; and a handling member on the second end of the stem, wherein both the application member and the stem are configured to flex upon application of the cosmetic product to a surface, the application member being configured to apply the cosmetic product to the surface by placing at least a portion of the length of the application member in contact with the surface.

62. The applicator of claim 61, wherein application member includes a tuft of bristles.

63. The applicator of claim 61, wherein the material forming at least a part of the stem is an elastomeric material.

64. The applicator of claim 63, wherein the elastomeric material is chosen from elastomers of polyethylene, of polyurethane, of polyester; polyether-block amides; polyvinyls; terpolymers of ethylene, propylene, and a diene; and styrene-butadiene block copolymers.

65. The applicator of claim 63, wherein the elastomeric material has a hardness ranging from 35 Shore A to 90 Shore A.

66. The applicator of claim 61, wherein the material forming at least part of the stem is wire.

67. The applicator of claim 61, wherein the application member has a length ranging from 8 mm to 40 mm.

68. The applicator of claim 61, wherein the surface is on one of a fingernail and skin.

69. An applicator for applying a cosmetic product, comprising:

a flexible stem having a first end and a second end;

a flexible application member on the first end of the stem, said application member extending substantially parallel to a longitudinal axis of the stem; and a handling member on the second end of the stem, wherein both the application member and the stem are configured to flex upon application of the cosmetic product to a surface, and at least part of the stem is formed of a material differing from a material forming at least part of the application member.

70. The applicator of claim 69, wherein application member includes a tuft of bristles.

71. The applicator of claim 69, wherein the material forming at least a part of the stem is an elastomeric material.

72. The applicator of claim 71, wherein the elastomeric material is chosen from elastomers of polyethylene, of polyurethane, of polyester; polyether-block amides; polyvinyls; terpolymers of ethylene, propylene, and a diene; and styrene-butadiene block copolymers.

73. The applicator of claim 71, wherein the elastomeric material has a hardness ranging from 35 Shore A to 90 Shore A.

74. The applicator of claim 69, wherein the material forming at least part of the stem is wire.

75. The applicator of claim 69, wherein the application member has a length ranging from 8 mm to 40 mm.

76. The applicator of claim 69, wherein the surface is on one of a fingernail and skin.

77. A cosmetic product application system, comprising:

a flexible stem having a first end and a second end;

a flexible application member on the first end of the stem;

a handling member on the second end of the stem; and a reservoir for containing a cosmetic product, the reservoir being configured to receive the application member, wherein both the application member and the stem are configured to flex upon application of the cosmetic product to a surface, and at least part of the stem is formed of a material differing from a material forming at least part of the application member.

78. The application system of claim 77, wherein the application member includes a tuft of bristles.

79. The application system of claim 77, wherein the material forming at least a part of the stem is an elastomeric material.

80. The application system of claim 79, wherein the elastomeric material is chosen from elastomers of polyethylene, of polyurethane, of polyester; polyether-block amides; polyvinyls; terpolymers of ethylene, propylene, and a diene; and styrenebutadiene block copolymers.

81. The application system of claim 79, wherein the elastomeric material has a hardness ranging from 35 Shore A to 90 Shore A.

82. The application system of claim 77, wherein the material forming at least part of the stem is wire.

83. The application system of claim 77, wherein the surface is on one of a fingernail and skin.

84. The application system of claim 77, wherein the reservoir contains a nail varnish.

85. A method of applying make-up to one of skin and fingernails, comprising:

providing an applicator including a flexible stem having a first end and a second end, a flexible application member on the first end of the stem, at least part of the stem being formed of a material differing from a material forming at least part of the application member, and a handling member on the second end of the stem, loading the application member with make-up;

applying the make-up to the one of skin and fingernails by drawing the application member across the one of skin and fingernails; and flexing both the stem and the application member during the applying of the make-up.

86. The applicator of claim 85, wherein the application member includes a tuft of bristles.

87. The applicator of claim 85, wherein the material forming at least a part of the stem is an elastomeric material.

88. The applicator of claim 87, wherein the elastomeric material is chosen from elastomers of polyethylene, of polyurethane, of polyester; polyether-block amides; polyvinyls; terpolymers of ethylene, propylene, and a diene; and styrene-butadiene block copolymers.

89. The applicator of claim 87, wherein the elastomeric material has a hardness ranging from 35 Shore A to 90 Shore A.

90. The applicator of claim 85, wherein the material forming at least part of the stem is wire.

91. An applicator for applying a cosmetic product, comprising:

a flexible stem having a first end and a second end, at least one portion of the stem having a flexibility greater than the remainder of the stem;

a flexible application member on the first end of the stem; and a handling member on the second end of the stem, wherein both the application member and the stem are configured to flex upon application of the cosmetic product to a surface, the application member being configured to apply the cosmetic product to the surface by placing at least a portion of the length of the application member in contact with the surface.

92. The applicator of claim 91, wherein the application member has a length ranging from 8 mm to 40 mm.

93. The applicator of claim 91, wherein the application member includes a tuft of bristles.

94. The applicator of claim 91, wherein the application member includes an elongate loop.

95. The applicator of claim 91, wherein the application member includes large finger-like bristles.

96. The applicator of claim 91, wherein the application member includes a spatula.

97. The applicator of claim 91, wherein at least a portion of the stem is made of an elastomeric material.

98. The applicator of claim 91, wherein at least a portion of the stem is made of wire.

99. The applicator of claim 91, wherein the surface is on one of a fingernail and skin.

100. An applicator for applying a cosmetic product, comprising:

a flexible stem having a first end and a second end, at least one portion of the stem having a flexibility greater than the remainder of the stem;

a flexible application member on the first end of the stem, the application member extending substantially parallel to a longitudinal axis of the stem; and a handling member on the second end of the stem, wherein both the application member and the stem are configured to flex upon application of the cosmetic product to a surface.

101. The applicator of claim 100, wherein the application member has a length ranging from 8 mm to 40 mm.

102. The applicator of claim 100, wherein the application member includes a tuft of bristles.

103. The applicator of claim 100, wherein the application member includes an elongate loop.

104. The applicator of claim 100, wherein the application member includes a spatula.

105. The applicator of claim 100, wherein the application member includes large finger-like bristles.

106. The applicator of claim 100, wherein at least a portion of the stem is made of an elastomeric material.

107. The applicator of claim 100, wherein at least a portion of the stem is made of wire.

108. The applicator of claim 100, wherein the surface is on one of a fingernail and skin.

109. A cosmetic product application system, comprising:

a flexible stem having a first end and a second end, at least one portion of the stem having a flexibility greater than the remainder of the stem;

a flexible application member on the first end of the stem;

a handling member on the second end of the stem; and a reservoir for containing a cosmetic product, the reservoir being configured to receive the application member, wherein both the application member and the stem are configured to flex upon application of the cosmetic product to a surface.

110. The application system of claim 109, wherein at least a portion of the stem is made of an elastomeric material.

111. The application system of claim 109, wherein at least a portion of the stem is made of wire.

112. The application system of claim 109, wherein the surface is on one of a fingernail and skin.

113. The application system of claim 109, wherein the reservoir contains nail varnish.

114. A method of applying make-up to one of skin and fingernails, comprising:

providing an applicator including a flexible stem having a first end and a second end, at least one portion of the stem having a flexibility greater than the remainder of the stem, a flexible application member on the first end of the stem, and a handling member on the second end of the stem;

loading the application member with make-up;

applying the make-up to the one of skin and fingernails by drawing the application member across the one of skin and fingernails; and flexing both the stem and the application member during the applying of the make-up.

115. The method of claim 114, wherein at least a portion of the stem is made of an elastomeric material.

116. The method of claim 114, wherein at least a portion of the stem is made of wire.

117. An applicator for applying a cosmetic product, comprising:

a flexible stem having a first end and a second end;

a flexible application member connected to the first end of the stem, wherein the application member and the stem are non-integral; and a handling member on the second end of the stem, wherein both the application member and the stem are configured to flex upon application of the cosmetic product to a surface, the application member being configured to apply the cosmetic product to the surface by placing at least a portion of the length of the application member in contact with the surface.

118. The applicator of claim 117, wherein the application member has a length ranging from 8 mm to 40 mm.

119. The applicator of claim 117, wherein the application member includes a tuft of bristles.

120. The applicator of claim 117, wherein the application member includes an elongate loop.

121. The applicator of claim 117, wherein the application member includes a spatula.

122. The applicator of claim 117, wherein the application member includes large finger-like bristles.

123. The applicator of claim 117, wherein the surface is on one of a fingernail and skin.

124. The applicator of claim 117, wherein the application member is connected to the stem by one of adhesive bonding, welding, and a staple.

125. An applicator for applying a cosmetic product, comprising:

a flexible stem having a first end and a second end;

a flexible application member connected to the first end of the stem, the application member extending substantially parallel to a longitudinal axis of the stem, wherein the application member and the stem are non-integral; and a handling member on the second end of the stem, wherein both the application member and the stem are configured to flex upon application of the cosmetic product to a surface.

126. The applicator of claim 125, wherein the application member has a length ranging from 8 mm to 40 mm.

127. The applicator of claim 125, wherein the application member includes a tuft of bristles.

128. The applicator of claim 125, wherein the application member includes an elongate loop.

129. The applicator of claim 125, wherein the application member includes a spatula.

130. The applicator of claim 125, wherein the application member includes large finger-like bristles.

131. The applicator of claim 125, wherein the surface is on one of a fingernail and skin.

132. The applicator of claim 125, wherein the application member is connected to the stem by one of adhesive bonding, welding, and a staple.

133. A cosmetic product application system, comprising:

a flexible stem having a first end and a second end;

a flexible application member connected to the first end of the stem, wherein the application member and the stem are non-integral;

a handling member on the second end of the stem; and a reservoir for containing cosmetic product, the reservoir being configured to receive the application member, wherein both the application member and the stem are configured to flex upon application of the cosmetic product to a surface.

134. The application system of claim 133, wherein the reservoir contains a nail varnish.

135. The application system of claim 133, wherein the surface is on one of a fingernail and skin.

136. The application system of claim 133, wherein the application member is connected to the stem by one of adhesive bonding, welding, and a staple.

137. A method of applying make-up to one of skin and fingernails, comprising:

providing an applicator including a flexible stem having a first end and a second end, a flexible application member connected to the first end of the stem, and a handling member on the second end of the stem, wherein the application member and the stem are non-integral;

loading the application member with make-up;

applying the make-up to the one of skin and fingernails by drawing the application member across the one of skin and fingernails; and flexing both the stem and the application member during the applying of the make-up.

138. The method of claim 137, wherein the application member is connected to the stem by one of adhesive bonding, welding, and a staple.

139. A method of applying a cosmetic product to an exterior body surface, the method comprising:

providing an applicator having a flexible stem having at least one region having a reduced cross-section as compared to the remainder of said stem, a handling member on a first end of the stem, and a flexible application member on a second end of the stem, wherein the remainder of the stem extends beyond the handling member;

providing the cosmetic product on the application member;

placing the application member with the cosmetic product in contact with the surface;

applying the cosmetic product to the surface by drawing at least a portion of the length of the application member across the surface; and flexing both the stem and the application member during the applying of the cosmetic product to the surface.

140. A method of applying a cosmetic product to an exterior body surface, the method comprising:

providing an applicator having a flexible stem having at least one region having a reduced cross-section as compared to the remainder of said stem, a handling member on a first end of the stem, and a flexible application member on a second end of the stem, said application member extending substantially parallel to a longitudinal axis of the stem, wherein the remainder of the stem extends beyond the handling member;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

141. A method of applying a cosmetic product to an exterior body surface, the method comprising:

providing an application system including an applicator having a flexible stem having at least one region having a reduced cross-section as compared to the remainder of said stem, a handling member on a first end of the stem, and a flexible application member on a second end of the stem, and a reservoir for containing a cosmetic product, said reservoir being configured to receive the application member, wherein the remainder of the stem extends beyond the handling member;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

142. A method of applying make-up to one of skin and fingernails, the method comprising:

providing an applicator having a flexible stem having at least one region having a reduced cross-section as compared to the remainder of said stem, a handling member on a first end of the stem, and a flexible application member on a second end of the stem, wherein the remainder of the stem extends beyond the handling member;

providing the make-up on the application member;

placing the application member with the make-up in contact with the one of skin and fingernails; and applying the make-up to the one of skin and fingernails by drawing the application member across the one of skin and fingernails; and flexing both the stem and the application member during the applying of the make-up.

143. A method of applying a cosmetic product to an exterior body surface, the method comprising:

providing an applicator having a flexible stem, a handling member on a first end of the stem, and a flexible application member on a second end of the stem, wherein at least part of the stem is formed of a material differing from a material forming at least part of the application member;

providing the cosmetic product on the application member;

placing the application member with the cosmetic product in contact with the surface;

applying the cosmetic product to the surface by drawing at least a portion of the length of the application member across the surface; and flexing both the stem and the application member during the applying of the cosmetic product to the surface.

144. A method of applying a cosmetic product to an exterior body surface, the method comprising:

providing an applicator having a flexible stem, a handling member on a first end of the stem, and a flexible application member on a second end of the stem, the application member extending substantially parallel to a longitudinal axis of the stem, wherein at least part of the stem is formed of a material differing from a material forming at least part of the application member;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

145. A method of applying a cosmetic product to an exterior body surface, the method comprising:

providing an application system including an applicator having a flexible stem, a handling member on a first end of the stem, and a flexible application member on a second end of the stem, and a reservoir for containing a cosmetic product, said reservoir being configured to receive the application member, wherein at least part of the stem is formed of a material differing from a material forming at least part of the application member;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

146. A method of applying make-up to one of skin and fingernails, the method comprising:

providing an applicator having a flexible stem, a handling member on a first end of the stem, and a flexible application member on a second end of the stem, wherein at least part of the stem is formed of a material differing from a material forming at least part of the application member;

providing the make-up on the application member;

placing the application member with the make-up in contact with the one of skin and fingernails;

applying the make-up to the one of skin and fingernails by drawing the application member across the one of skin and fingernails; and flexing both the stem and the application member during the applying of the make-up.

147. A method of applying a cosmetic product to an exterior body surface, the method comprising:

providing an applicator having a flexible stem with at least one portion of the stem having a flexibility greater than the remainder of the stem, a handling member on a first end of the stem, and a flexible application member on a second end of the stem providing the cosmetic product on the application member;

placing the application member with the cosmetic product in contact with the surface;

applying the cosmetic product to the surface by drawing at least a portion of the length of the application member across the surface; and flexing both the stem and the application member during the applying of the cosmetic product to the surface.

148. A method of applying a cosmetic product to an exterior body surface, the method comprising:

providing an applicator having a flexible stem with at least one portion of the stem having a flexibility greater than the remainder of the stem, a handling member on a first end of the stem, and a flexible application member on a second end of the stem, the application member extending substantially parallel to a longitudinal axis of the providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

149. A method of applying a cosmetic product to an exterior body surface, the method comprising:

providing an application system including an applicator having a flexible stem with at least one portion of the stem having a flexibility greater than the remainder of the stem, a handling member on a first end of the stem, and a flexible application member on a second end of the stem, and a reservoir for containing a cosmetic product, the reservoir being configured to receive the application member;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

150. A method of applying make-up to one of skin and fingernails, the method comprising:

providing an applicator having a flexible stem with at least one portion of the stem having a flexibility greater than the remainder of the stem, a handling member on a first end of the stem, and a flexible application member on a second end of the stem providing the make-up on the application member;

placing the application member with the make-up in contact with the one of skin and fingernails;

applying the make-up to the one of skin and fingernails by drawing the application member across the one of skin and fingernails; and flexing both the stem and the application member during the applying of the make-up.

151. A method of applying a cosmetic product to an exterior body surface, the method comprising:

providing an applicator having a flexible stem, a handling member on a first end of the stem, and a flexible application member connected to a second end of the stem, wherein the application member and the stem are non-integral;

providing the cosmetic product on the application member;

placing the application member with the cosmetic product in contact with the surface;

applying the cosmetic product to the surface by drawing at least a portion of the length of the application member across the surface; and flexing both the stem and the application member during the applying of the cosmetic product to the surface.

152. A method of applying a cosmetic product to an exterior body surface, the method comprising:

providing an applicator having a flexible stem, a handling member on a first end of the stem, and a flexible application member connected to a second end of the stem, the application member extending substantially parallel to a longitudinal axis of the stem, wherein the application member and the stem are non-integral;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

153. A method of applying a cosmetic product to an exterior body surface, the method comprising:

providing an application system including an applicator having a flexible stem, a handling member on a first end of the stem, and a flexible application member connected to a second end of the stem, and a reservoir for containing a cosmetic product, said reservoir being configured to receive the application member, wherein the application member and the stem are non-integral;

providing the cosmetic product on the application member;

placing the application member with the cosmetic product in contact with the surface;

applying the cosmetic product to the surface by drawing the application member across the surface; and flexing both the stem and the application member during the applying of the cosmetic product to the surface.

154. A method of applying make-up to one of skin and fingernails, the method comprising:

providing an applicator having a flexible stem, a handling member on a first end of the stem, and a flexible application member connected to a second end of the stem, wherein the application member and the stem are non-integral;

providing the make-up on the application member;

placing the application member with the make-up in contact with the one of skin and fingernails;

applying the make-up to the one of skin and fingernails by drawing the application member across the one of skin and fingernails; and flexing both the stem and the application member during the applying of the make-up.

* * * * *

UNITED STATES PATENT AND TRADEMARK OFFICE

CERTIFICATE OF CORRECTION

PATENT NO. : 6,341,912 B1
DATED : January 29, 2002
INVENTOR(S) : Jean-Louis H. Gueret It is certified that error appears in the above-identified patent and that said Letters Patent is hereby corrected as shown below:

Column 8,
Line 27, replace "claim, 3," with -- claim 3, --.
Line 43, replace "claim 3" with -- claim 13 --.
Line 47, replace "wherein surface" with -- wherein a surface --.

Column 9,
Line 10, replace "proplylene" with -- propylene --.

Column 10,
Line 14, replace "5." with -- 0.5. --.

Column 18,
Line 27, replace "of the" with -- of the stem; --.

Signed and Sealed this

Twenty-first Day of May, 2002

*Attest:*

*Attesting Officer*

JAMES E. ROGAN
*Director of the United States Patent and Trademark Office*